US006593049B1

(12) United States Patent
Veregin et al.

(10) Patent No.: US 6,593,049 B1
(45) Date of Patent: Jul. 15, 2003

(54) TONER AND DEVELOPER COMPOSITIONS

(75) Inventors: Richard P. N. Veregin, Mississauga (CA); Reza Stegamat, Burlington (CA); Rina Carlini, Mississauga (CA); Guerino G. Sacripante, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/817,737

(22) Filed: Mar. 26, 2001

(51) Int. Cl.[7] ..... G03G 9/00
(52) U.S. Cl. ..... 430/108.1; 430/108.11
(58) Field of Search ..... 430/108.1, 108.11

(56) References Cited

U.S. PATENT DOCUMENTS

| | | | | |
|---|---|---|---|---|
| 4,206,064 A | | 6/1980 | Kiuchi et al. | 430/106 |
| 4,221,856 A | | 9/1980 | Lu | 430/110 |
| 4,323,634 A | | 4/1982 | Jadwin | 430/110 |
| 4,326,019 A | | 4/1982 | Lu et al. | 430/108 |
| 4,490,455 A | | 12/1984 | Hoffend et al. | 430/110 |
| 4,604,338 A | | 8/1986 | Gruber et al. | 430/106 |
| 4,684,596 A | | 8/1987 | Bonser et al. | 430/110 |
| 4,752,550 A | | 6/1988 | Barbetta et al. | 430/106.6 |
| 4,792,513 A | | 12/1988 | Gruber et al. | 430/110 |
| 4,812,381 A | | 3/1989 | Bugner et al. | 430/110 |
| 4,826,749 A | | 5/1989 | Kawagishi et al. | 430/110 |
| 4,834,921 A | | 5/1989 | Eugner et al. | 260/501.15 |
| 4,917,982 A | | 4/1990 | Tomono et al. | 430/99 |
| 4,921,771 A | | 5/1990 | Tomono et al. | 430/110 |
| 4,937,166 A | | 6/1990 | Creatura et al. | 430/108 |
| 4,988,598 A | | 1/1991 | Tomono et al. | 430/99 |
| 4,997,739 A | | 3/1991 | Tomono et al. | 430/110 |
| 5,004,666 A | | 4/1991 | Tomono et al. | 430/110 |
| 5,023,158 A | | 6/1991 | Tomono et al. | 430/99 |
| 5,512,406 A | * | 4/1996 | Takeda et al. | 430/108.11 |

* cited by examiner

*Primary Examiner*—Mark A. Chapman
(74) *Attorney, Agent, or Firm*—E. O. Palazzo

(57) ABSTRACT

A toner comprised of resin and a charge additive comprised of a complex of a hard acid and a hard base.

22 Claims, No Drawings

TONER AND DEVELOPER COMPOSITIONS

BACKGROUND OF THE INVENTION

This invention is generally directed to toner and developer compositions, and more specifically, the present invention is directed to developer and toner compositions containing charge enhancing additives, which impart or assist in imparting a negative charge to the toner resin particles and enable in embodiments toners with rapid admix characteristics. In embodiments, there are provided in accordance with the present invention toner compositions comprised of resin particles, colorant particles, and a charge additive of a metal complex comprised, for example, of a hard acid metal ion, such as aluminum with a valence of three, zinc with a valence of two, and a hard base, such as sulfate, acetate, phosphate, and the like. Hard acid refers, for example, to a Lewis acid comprised of an electron-accepting ion or group with a softness character that is, for example, an intrinsic quantity calculated on properties of ions, such as ionization potential, electron affinity, and size, as illustrated by G. Klopman in the R. G. Pearson reference mentioned herein, the disclosure of which is totally incorporated herein by reference, and which softness is, for example, from about 0.0 eV (electron volts) to 7 eV and, more specifically, from about 1 eV to 6.1 eV, including for example, ions of $Li^+$(lithium+1 ion), $Na^+$(sodium +1 ion), $K^+$(potassium +1 ion), $Mg^{2+}$(magnesium +2 ion), $Ca^{2+}$(calcium +2 ion), $Ce^{4+}$ (cerium +4 ion), $Ti^{4+}$(titanium +4 ion), $Cr^{3+}$(chromium +3 ion), $Fe^{3+}$(iron +3 ion), $Co^{3+}$(cobalt +3 ion), $BF_3$(boron fluoride), $Al^{3+}$(aluminum +3 ion), $Sn^{4+}$(tin +4 ion), HX where X is a heteroatom-containing group such as $NH_3$, OH, and the like, as illustrated in a monograph authored by R. G. Pearson, "*Hard and Soft Acids and Bases*", Dowden, Hutchinson and Roe: Stroudsburg, Pa. 1973, the disclosure of which is totally incorporated herein by reference. Hard base refers, for example, to a Lewis base comprised of an electron-donating ion or group with a softness character of, for example, from about −8.5 eV to about −13 and, more specifically, from about −9 eV to about −12.2 eV or with a softness number that is, for example, the reaction rate with dichlorobis(pyridine)platinum II, $Pt(C_5H_5N)_2Cl_2$, as illustrated in the referenced R. G. Pearson reference, of from about 0.0 to about 4.4 and, more specifically, from about 0.0 to about 2.5 and which hard bases include, for example, $NH_3$ (ammonia), $OH^-$(hydroxide), $NO_2^-$(nitrite), $CH_3CO_2^-$ (acetate), $CO_3^{2-}$(carbonate), $NO_3^-$(nitrate), $PO_4^{3-}$ (phosphate), $SO_4^{2-}$(sulfate), $ClO_4^-$(perchlorate), $F^-$(fluoride), and $Cl^-$(chloride).

The charge additives in embodiments of the present invention enable, for example, toners with rapid admix of less than about 15 seconds, high triboelectric charging values, such as for example, from about 35 to about 60 and preferably from about 40 to about 50 microcoulombs per gram as measured by the known charge spectrograph, or by the known Faraday cage method, extended developer life, stable electrical properties, high image print quality with substantially no background deposits, improved RH sensitivity especially for polyester toners, and compatibility with fuser rolls including VITON fuser rolls. Also, the aforementioned toner compositions, usually colorless, can be rendered colored with colorant particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles, exceeding, for example, about 1,000,000 in a number of embodiments. The toner and developer compositions of the present invention can be selected for electrophotographic, especially xerographic, imaging and printing processes, including color processes, and more specifically, for the Xerox Corporation 265 machine.

PRIOR ART

Developer compositions with charge enhancing additives, which impart a positive charge to the toner resin, are known. Thus, for example, there is described in U.S. Pat. No. 3,893,935, the disclosure of which is totally incorporated herein by reference, the use of quaternary ammonium salts as charge control agents for electrostatic toner compositions. In this patent, there are disclosed quatemary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856, the disclosure of which is totally incorporated herein by reference, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111, the disclosures of which are totally incorporated herein by reference; and similar teachings are presented in U.S. Pat. No. 4,291,112, the disclosure of which is totally incorporated herein by reference, wherein A is an anion including, for example, sulfate, sulfonate, nitrate, borate, chlorate, and the halogens. There are also described in U.S. Pat. No. 2,986,521, the disclosure of which is totally incorporated herein by reference, reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and colorant particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430, and 4,560,635, the disclosures of which are totally incorporated herein by reference, which illustrates a toner with a distearyl dimethyl ammonium methyl sulfate charge additive.

The following prior art, all United States patents, was located in a search for toners with charge additives: U.S. Pat. No. 4,812,381, the disclosure of which is totally incorporated herein by reference, which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; also note, for example, the information presented in column 2 and beginning with column 3 of this patent; a similar teaching is presented in U.S. Pat. No. 4,834,921, the disclosure of which is totally incorporated herein by reference; U.S. Pat. No. 4,490,455, the disclosure of which is totally incorporated herein by reference, which discloses toners with, for example, amine salt charge enhancing additives, reference the Abstract of the Disclosure, for example, and wherein a is an anion including those derived from aromatic substituted sulfonic acids, such as benzene sulfonic acid, and the like, see column 3 beginning at line 33; U.S. Pat. No. 4,221,856, the disclosure of which is totally incorporated herein by reference, directed to toners with a quaternary ammonium compound wherein A is an anion such as sulfate, sulfonate, nitrate, borate, chlorate, and certain halogens, see the Abstract of the Disclosure; Reissue 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634, the disclosure of which is totally incorporated herein by reference, which discloses toners with charge additives of the formulas presented in column 3, wherein proving that at least one of the Rs is a long chain amido group, and X is a halide ion or an organosulfur containing group; U.S. Pat. No. 4,326,019, the disclosure of which is totally incorporated herein by reference, relating to toners with long chain hydrazinium compounds, wherein the anion A can be a sulfate, sulfonate, phosphate, halides, nitrate, see the Abstract of the Disclosure, for example; U.S. Pat. No. 4,752,550, the disclosure of which is totally incorporated herein by reference, which illustrates toners with inner salt charge additives, or mixtures of charge additives, see for example column 8; U.S. Pat. No. 4,684,596, the disclosure of which is totally incorporated herein by reference, which discloses toners with charge additives of the formula provided in column 3 wherein X can be variety of anions such as trifluoromethane sulfonate, and U.S. Pat. Nos. 4,604,338; 4,792,513; 3,893,935; 4,826,749, and 4,604,338, the disclosures of which are totally incorporated herein by reference.

In U.S. Pat. No. 4,812,381, the disclosure of which is totally incorporated herein by reference, there are illustrated toners and developers with quatemary ammonium salts of the formula illustrated in column 3, the preparation thereof, see column 4, and also note the working Examples, columns 7 and 8, wherein specific charge additives, such as octadecyl ammonium trifluoromethane sulfonate, are reported; U.S. Pat. No. 4,675,118, the disclosure of which is totally incorporated herein by reference, which discloses certain quatemary salts as fabric softeners, see the Abstract of the Disclosure, and note column 1, for example, wherein X is as recited including $OSO_3CH_3$ and halide; U.S. Pat. No. 4,752,550, the disclosure of which is totally incorporated herein by reference, directed to toners and developers with inner salt charge additives and mixtures of such salts with other charge additives, see for example column 4; Reissue 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example; and U.S. Pat. No. 4,058,585, the disclosure of which is totally incorporated herein by reference.

Toners with complex additives are illustrated in U.S. Pat. Nos. 4,845,003; 5,275,900; 5,290,651; 5,300,387; 5,302,481; 5,332,636 and 5,391,453.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, colorant particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271, the disclosure of which is totally incorporated herein by reference, a toner for developing electrostatic images, which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937, the disclosures of which are totally incorporated herein by reference. Also, in U.S. Pat. No. 4,433,040, the disclosure of which is totally incorporated herein by reference, there are illustrated toner compositions with chromium and cobalt complexes of azo dyes as negative charge enhancing additives.

Although many charge enhancing additives are known, there continues to be a need for toners with additives, which toners possess a number of the advantages illustrated herein. Additionally, there is a need for positive and negative charge enhancing additives which are useful for incorporation into black, and/or colored toner compositions. Moreover, there is a need for colored toner compositions containing certain metal complex charge enhancing additives. There is also a need for toner compositions with certain charge enhancing additives, which toners in embodiments thereof possess acceptable and substantially stable triboelectric charging characteristics, RH insensitivity, especially for polyester containing toners and excellent admixing properties. Moreover, there continues to be a need for negatively charged toner and developer compositions. Further, there is a need for toners with certain charge enhancing additives which can be easily and permanently dispersed into toner resin particles. There also is a need for negatively charged black, and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which possess a desired high triboelectric charge level, for example, from about 30 to about 70 microcoulombs per gram, and preferably from about 40 to about 50 microcoulombs per gram, and admix charging rates of from about 5 to about 60 seconds, and preferably from about 15 to about 30 seconds, as determined by the charge spectrograph, preferably for example at low concentrations, that is for example less than 1 percent, and preferably less than about 0.5 percent of the charge enhancing additive of the present invention.

SUMMARY OF THE INVENTION

It is a feature of the present invention to provide toner and developer compositions with charge enhancing additives.

In another feature of the present invention there are provided positively charged toner compositions useful for the development of electrostatic latent images including color images.

In yet another feature of the present invention there are provided positively charged toner compositions containing certain metal complex charge additives.

In yet another feature of the present invention there are provided negatively charged toner compositions.

Another feature of the present invention resides in providing toner compositions with mixtures of charge enhancing additives.

Also, in another feature of the present invention there are provided developer compositions with negatively charged toner particles, carrier particles, and the enhancing additives illustrated herein, or mixtures of these additives with other known charge enhancing additives.

In yet a further feature of the present invention there are provided humidity insensitive, from about, for example, 20 to 80 percent relative humidity at temperatures of from 15° C. to 28° C. as determined in a relative humidity testing chamber, negatively charged toner compositions with desirable admix properties of 5 seconds to 60 seconds as determined by the charge spectrograph, and more specifically, less than 15 seconds, for example, and more specifically, from about 1 to about 14 seconds, and acceptable high triboelectric charging values of from about 40 to about 60 microcoulombs per gram.

Additionally, in a further feature of the present invention there are provided negatively charged magnetic toner compositions, and negatively charged colored toner compositions containing therein, or thereon metal charge enhancing additives.

Furthermore, in yet another feature of the present invention there are provided toner and developer compositions with charge enhancing additives, which compositions are useful in a variety of electrostatic imaging and printing processes, including color xerography, and wherein the admix charging times are less than about 60 seconds.

Another feature of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

These and other features of the present invention can be accomplished in embodiments thereof by providing toner compositions comprised of resin particles, optional colorant particles, and the charge enhancing additives illustrated herein. More specifically, the present invention in embodiments is directed to toner compositions comprised of resin, colorant, and a metal complex charge enhancing additive. The aforementioned charge additive can be incorporated into the toner, may be present on the toner surface, or may be present on toner surface additives such as colloidal silica particles. Also, the toners of the present invention may contain mixtures of the aforementioned charge additive with other charge additives, such as distearyl dimethyl ammonium methylsulfate, the bisulfates, and charge additives of the U.S. Pat. Nos. 4,937,157 and 4,904,762, the disclosures of which are totally incorporated herein by reference, the charge additives of the patents mentioned herein; and the like. With mixtures from about 0.05 to about 1 percent by weight of the charge enhancing additive of the present invention can be selected, and from about 0.05 to about 1 percent of a second charge enhancing additive can be selected in embodiments of the present invention. Other amounts of mixtures may also be selected in embodiments of the present invention.

Aspects of the present invention relate to a toner composition comprised of resin, and charge enhancing additive comprised of a complex of a hard acid A and a hard base B; a toner composition comprised of resin, colorant, and a charge enhancing additive comprised of a complex of a hard acid A with charge of +n, and a hard base B with charge of −m, where n, m are each independently the numbers 2, 3, or 4; a toner containing a charge enhancing additive of the formula $(A^{+n})_m (B^{-m})_n$ and the hydrates thereof, wherein A is $Al^{+3}$, $Zn^{+2}$, $Ti^{+4}$, or $Cr^{+3}$ and B is $SO_4^{-2}$, $CH_3CO_2^-$, $PO_4^{-3}$, $NO_3^-$, $CO_3^{-2}$, and $(A^{+n})_m(B^{-m})_n$ is $Al_2(SO_4)_3$, $Zn(CH_3CO_2)_2$, $Al(CH_3CO_2)_3$, $Al_2(CO_3)_3$, $AlPO_4$, $ZnSO_4$, $ZnCO_3$, $Zn(NO_3)_2$, $Ti(SO_4)_2$ $Ti(CH_3CO_2)_4$, $Cr(CH_3CO_2)_3$, $Cr_2(SO_4)_3$, or $Cr(CH_3CO_2)_3$, and B is a hard base; a toner containing a charge enhancing additive of a complex of aluminum sulfate, zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III). carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, or ammonium sulfate; a toner composition containing a charge additive of aluminum sulfate, zinc acetate dihydrate, or chromium acetate; a toner containing a second charge enhancing selected from the group consisting of distearyl methyl hydrogen ammonium bisulfate, didodecyl methyl ammonium hydrogen bisulfate, dihexadecyl methyl ammonium hydrogen bisulfate, distearyl ethyl ammonium hydrogen bisulfate, and bis-(distearyl methyl hydrogen ammonium) sulfate wherein the first charge additive is present in an amount of from about 0.05 to about 5 weight percent of additive in toner and the second charge additive is present in an amount of from about 0.05 to about 5 weight percent; a toner containing a second charge enhancing additive selected form the group consisting of distearyl dimethyl ammonium methyl sulfonate, distearyl dimethyl ammonium trifluoromethyl sulfonate, didodecyl dimethyl ammonium hydrogen methyl sulfonate, dihexadecyl methyl ammonium hydrogen methyl sulfonate, didodecyl trifluoromethyl ammonium hydrogen methyl sulfonate, dihexadecyl methyl ammonium hydrogen trifluoromethyl sulfonate, and distearyl diethyl ammonium ethyl sulfonate, trifluoromethyl ammonium hydrogen methyl sulfonate; a toner composition wherein the complex charge additive is present in an amount of from about 0.05 to about 5 weight percent, or is present in an amount of from about 0.1 to about 3 weight percent of toner; a toner composition wherein the charge additive is incorporated into the toner, is present on the surface of the toner composition, or is contained on colloidal silica particles; a toner composition with an admix time of from less than about 15 seconds; a toner composition with an admix time of from about 1 to about 14 seconds and with a triboelectric charge of from about 30 to about 60 microcoulombs per gram; a toner composition wherein a colloidal silica is treated with the complex charge enhancing additive, and the resulting composition is present on the surface of the toner; a toner containing resin particles comprised of styrene acrylates, styrene methacrylates, or styrene butadienes; a toner composition further containing a wax component with a weight average molecular weight of from about 1,000 to about 10,000 and wherein the wax component is, for example, selected from the group consisting of polyethylene and polypropylene; a toner composition containing as external surface additives metal salts of a fatty acid, colloidal silicas, or mixtures thereof; a toner composition wherein the colorant is carbon black, magnetites, or mixtures thereof, cyan, magenta, yellow, red, blue, green, brown, and mixtures thereof; a developer composition comprised of the toner illustrated herein and carrier particles; a developer composition wherein the carrier core particles are comprised of ferrites, steel, or an iron powder; a developer composition wherein the carrier particles are comprised of a core with a polymer coating thereover and wherein the coating is, for example, comprised of a methyl terpolymer, a polyvinylidine fluoride, a polymethyl methacrylate, or a mixture of polymers not in close proximity in the triboelectric series; a method of imaging which comprises formulating an electrostatic latent image on a photoreceptor, affecting development thereof with the toner or developer illustrated herein, and thereafter transferring the developed image to a suitable substrate, and wherein the transferred image is optionally permanently fixed to the substrate; a single component toner composition comprised of resin, magnetite, and the charge enhancing complex illustrated herein; a toner composition comprised of resin, colorant, and a complex charge enhancing additive comprised of a hard acid metal ion of aluminum three, zinc two, magnesium two, chromium three, cobalt three, cerium four, iron three, calcium two, and a hard base ion of acetate, sulfate, phosphatecarbonate, phosphate, nitrate, chloride, fluoride; a toner wherein the toner resin is a polyester of 4,4'-hydroxy ethoxy bisphenol A terephthalate, and 1,4-cyclohexane dimethanol terephthalate, a polyester of propoxylated bisphenol A and fumaric acid, or a polyester of terephthalic acid, propylene glycol, diethylene glycol, and sodium sulfoisophthalate; a toner composition comprised of resin, colorant, known toner additives, and charge enhancing additive comprised of a complex of a hard acid and a hard base; a toner comprised of resin and a charge additive comprised of a complex of a hard acid and a hard base; a toner composition comprised of resin, colorant, and a charge enhancing additive comprised of a complex of a hard acid A with charge of +n, and a hard base B with charge of −m, where n, m are each independently a number of about 2, 3, or 4; a single component toner composition comprised of resin, magnetite, and a charge enhancing additive comprised of a complex of a hard acid and a hard base; and a toner composition comprised of resin, colorant, and a complex charge enhancing additive comprised of a hard acid metal ion of aluminum three, zinc two, magnesium two, chromium three, cobalt three, cerium four, iron three, or calcium two, and a hard base ion of acetate, sulfate, phosphate carbonate, phosphate, nitrate, chloride, or fluoride.

Examples of charge enhancing additives are metal complexes such as those containing metal ions such as aluminum with a valence of three, zinc with a valence of two, titanium with a valence of four, chromium with a valence of three, complexed with counterions of sulfate, acetate, phosphate, nitrate, carbonate, and the like, and more specifically, aluminum sulfate, zinc acetate complexes, aluminum sulfate, aluminum acetate, aluminum carbonate, aluminum phosphate, zinc sulfate, zinc acetate, zinc carbonate, zinc nitrate, titanium sulfate, titanium acetate, chromium (III) acetate, chromium (III) sulfate, chromium (III) carbonate; complexes containing a hard acid A with charge of +n, and a hard base B with charge of −m, where n, m is an appropriate number such as 1, 2, 3, or 4 with the general formula $(A^{+n})_m (B^{-m})_n$ wherein A can be $Al^{+3}$, $Zn^{+2}$, $Ti^{+4}$, or $Cr^{+3}$ and the like, and B can be $SO_4^{-2}$, $CH_3CO_2^-$, $PO_4^{-3}$, $NO_3^-$, $CO_3^{-2}$, and the like, and $(A^{+n})_m (B^{-m})_n$ can be $Al_2(SO_4)_3$, $Zn(CH_3CO_2)_2$, $Al(CH_3CO_2)_3$, $Al_2(CO_3)_3$, $AlPO_4$, $ZnSO_4$, $ZnCO_3$, $Zn(NO_3)_2$, $Ti(SO_4)_2$ $Ti(CH_3CO_2)_4$, $Cr(CH_3CO_2)_3$, $Cr_2)SO_4)_3$, $Cr(CH_3CO_2)_3$, and the like, available from, for example, Aldrich Chemical Company.

Illustrative examples of suitable toner resins selected for the toner and developer compositions of the present invention include polyesters, polyamides, polyolefins, styrene acrylates, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers; with a styrene content of form about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

Other suitable polyesters are metal-complexed sulfonated polyester of the general formula as illustrated in Formula 2.

Formula 2

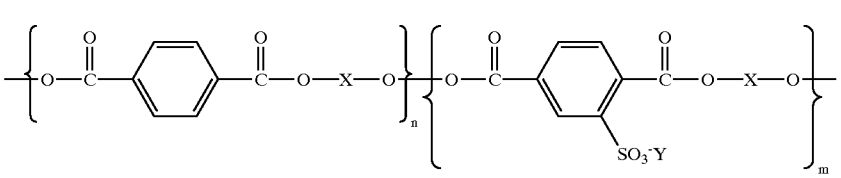

wherein Y is a monovalent alkali Group 1 metal ion of, for example, lithium, sodium, and potassium, Y is a divalent alkaline earth Group 2 metal ion, for example, berylium, magnesium, calcium, and barium, or Y is a multivalent transition metal ion of, for example, scandium, yttrium, lanthanides, titanium, zirconium, hafnium, vanadium, chromium, niobium, tantalum, molybdenum, tungsten, manganese, rhenium, iron, ruthenium, osmium, cobalt, rhodium, iridium, nickel, palladium, copper, platinum, silver, gold, zinc, cadmium, mercury, aluminum, or mixtures thereof. The substituent X shown in the general formula represents alkyl groups generated, for example, from a glycol monomer, wherein the glycol is neopentyl glycol, ethylene glycol, propylene glycol, butylene glycol, diethylene glycol, dipropylene glycol, or mixtures thereof, and n and m represent the number of segments. The present invention also relates to a toner wherein the core resin is the magnesium salt of copoly(1,2-propylene-dipropylene-5-sulfoisophthalate)-copoly(1,2-propylene-dipropylene terephthalate), the magnesium salt of copoly(1,2-propylene-diethylene-5-sulfoisophthalate)-copoly(1,2-propylene-diethylene terephthalate), the calcium salt of copoly(1,2-propylene-dipropylene-5-sulfoisophthalate)-copoly(1,2-propylene-dipropylene terephthalate), the calcium salt of copoly(1,2-propylene-diethylene-5-sulfoisophthalate)-copoly(1,2-propylene-diethylene terephthalate), the barium salt of copoly(1,2-propylene-diethylene-5-sulfoisophthalate)-copoly(1,2-propylene-diethylene terephthalate); the barium salt of copoly(1,2-propylene-dipropylene-5-sulfoisophthalate)-copoly(1,2-propylene-dipropylene terephthalate); the zinc salt of copoly(1,2-propylene-diethylene-5-sulfoisophthalate)-copoly(1,2-propylene-diethylene terephthalate), the zinc salt of copoly (1,2-propyl-dipropylene-5-sulfoisophthalate)-copoly(1,2-propylene-dipropylene terephthalate), the vanadium salt of copoly(1,2-propylene-dipropylene-5-sulfoisophthalate)-copoly(1,2-propylene-dipropylene terephthalate); the vanadium salt of copoly(1,2-propylene-diethylene-5-sulfoisophthalate)-copoly(1,2-propylene-diethylene terephthalate); the copper salt of copoly(1,2-propylene-dipropylene-5-sulfoisophthalate)-copoly(1,2-propylene-dipropylene terephthalate); or the copper salt of copoly(1,2-propylene-diethylene-5-sulfoisophthalate)-copoly(1,2-propylene-diethylene terephthalate); a toner wherein segments n and m represent about 10 to about 30 each, and wherein the weight average molecular weight of the polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof; extruded polyesters, reference U.S. Pat. No. 6,139,674, the disclosure of which is totally incorporated herein by reference. Also, waxes with a molecular weight, $M_w$, of from about 1,000 to about 10,000, such as polyethylene, polypropylene, and paraffin waxes, can be included in, or on the toner compositions as fuser roll release agents.

As a specific toner resin, there can be selected polyesters, generated from a monomer addition process comprising first alkoxylating a dihydroxy containing monomer, such as a dihydroxy alkane or dihydroxy arylene with a cyclic akylene carbonate in the presence of a catalyst, such as an alkali carbonate, optionally followed by the addition of a further amount of cyclic alkylene carbonate in the presence of a second catalyst, such as an alkali alkoxide, and followed by a subsequent addition of a diacid, such as a saturated or unsaturated aliphatic diacid or aromatic diacid, to enable the formation of a saturated or unsaturated polyester resin, as described in U.S. Pat. No. 6,063,827, the disclosure of which is totally incorporated herein by reference.

The resin particles are present in a sufficient, but effective amount, for example from about 70 to about 90 weight percent. Thus, when 1 percent by weight of the charge enhancing additive is present, and 10 percent by weight of colorant or colorant, such as carbon black, is contained therein, about 89 percent by weight of resin is selected. Also, the charge enhancing additive may be coated on the colorant particles. When used as a coating, the charge enhancing additive, for example, is present in an amount of from about 0.1 weight percent to about 5 weight percent, and preferably from about 0.3 weight percent to about 1 weight percent.

Numerous well known suitable colorants or dyes can be selected as the colorant for the toner particles including, for example, carbon black, nigrosine dye, aniline blue, magnetite, or mixtures thereof. The colorant, such as carbon black, should be present in a sufficient amount to render the toner composition highly colored. Generally, the colorant particles are present in amounts of from about 1 percent by weight to about 20 percent by weight, and more specifically, from about 2 to about 10 weight percent based on the total weight of the toner composition; however, lesser or greater amounts of colorant particles can be selected.

When the colorant particles are comprised of magnetites, thereby enabling single component toners in some instances, which magnetites are a mixture of iron oxides ($FeO.Fe_2O_3$) including those commercially available as MAPICO BLACK, they are present in the toner composition in an amount of from about 10 percent by weight to about 70 percent by weight, and more specifically in an amount of from about 10 percent by weight to about 50 percent by weight. Mixtures of carbon black and magnetite with from about 1 to about 15 weight percent of carbon black, and more specifically from about 2 to about 6 weight percent of carbon black, and magnetite, such as MAPICO BLACK, in an amount of, for example, from about 5 to about 60, and more specifically from about 10 to about 50 weight percent can be selected.

There can also be blended with the toner compositions of the present invention external additive particles including flow aid additives, which additives are usually present on the surface thereof. Examples of these additives include colloidal silicas such as AEROSIL™, metal salts and metal salts of fatty acids inclusive of zinc stearate, aluminum oxides, cerium oxides, coated silicas, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 6,004,714; 3,590, 000 and 3,800,588, the disclosures of which are totally incorporated herein by reference, and in copending application U.S. Ser. No. 09/132,623, the disclosures of which are totally incorporated herein by reference.

With further respect to the present invention, colloidal silicas, such as AEROSIL™, can be surface treated with the charge additives of the present invention illustrated herein in an amount of from about 1 to about 30 weight percent and more specifically 10 weight percent followed by the addition thereof to the toner in an amount of from 0.1 to 10 and more specifically 0.1 to 1 weight percent.

Also, as indicated herein there can be included in the toner compositions of the present invention low molecular weight waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835; U.S. Pat. Nos. 4,917,982; 4,921,771; 4,988,598; 4,997,739; 5,004,666 and 5,023,158, the disclosures of which are totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored, other than full black, toner and developer compositions comprised of toner resin particles, optional carrier particles, the charge enhancing additives illustrated herein, and as colorants or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as colorants include copper tetra-4-(octadecyl sulfonamido) phthalocyanine, X-copper phthalocyanine colorant listed in the Color Index as CI 74160, CI Colorant Blue, and Anthrathrene Blue, identified in the Color Index as CI 69810, Special Blue X-2137, and the like; while illustrative examples of yellow colorants that may be selected are diarylide yellow 3,3-dichlorobenzidene acetoacetanilides, a monoazo colorant identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, and Permanent Yellow FGL. The aforementioned colorants are incorporated into the toner composition in various suitable effective amounts providing the features of the present invention are achieved. In embodiments, these colored colorant particles are present in the toner composition in an amount of from about 2 percent by weight to about 15 percent by weight calculated on the weight of the toner components or toner resin.

Examples of dyes include food dyes and other known dyes, reference the color index.

For the formulation of developer compositions, there are mixed with the toner particles carrier components, particularly those that are capable of triboelectrically assuming an opposite polarity to that of the toner composition. Accordingly, the carrier particles of the present invention can be selected to be of a positive or negative polarity enabling the toner particles, which are preferably negatively charged, to adhere to and surround the carrier particles. Illustrative examples of carrier particles include iron powder, steel, nickel, iron, ferrites, including copper zinc ferrites, strontium ferrite, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,935,326 and 4,937,166, the disclosures of which are totally incorporated herein by reference, including for example KYNAR™ and polymethylmethacrylate mixtures (40/60). Coating weights can vary as indicated herein; generally, however, from about 0.3 to about 2, and more specifically, from about 0.5 to about 1.5 weight percent coating weight is selected.

Furthermore, the diameter of the carrier particles, preferably spherical in shape, is generally from about 50 microns to about 1,000 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner composition of the present invention can be prepared by a number of known methods including extrusion melt blending the toner resin particles, colorant particles or colorants, and the charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated with charge additive colloidal silicas. Further, other methods of preparation for the toner are as illustrated herein. Moreover, the toner compositions of the present invention can be prepared by emulsion/aggregation/coalescence processes, reference U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No.

5,346,797 Also of interest may be U.S. Pat. Nos. 5,348,832; 5,405,728; 5,366,841; 5,496,676; 5,527,658; 5,585,215; 5,650,255; 5,650,256; 5,501,935; 5,919,595; 5,916,725; 5,902,710; 5,863,698 and 5,858,601.

Moreover, the toner compositions of the present invention can be prepared by a number of known methods such as admixing and heating resin particles such as styrene butadiene copolymers, colorant particles such as magnetite, carbon black, dyes, or mixtures thereof, and from about 0.5 percent to about 5 percent of the complex charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

The toner and developer compositions of the present invention may be selected for use in electrostatographic imaging apparatuses. Thus, the toner and developer compositions of the present. invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the features of the present invention are achievable.

With further respect to the present invention, one developer composition contains toner and carrier particles comprised of a core containing thereover a plurality and preferably two polymeric coatings, namely a first polymeric coating of, for example, KYNAR™, 60 weight percent, and a second polymeric coating of, for example, polymethylmethacrylate, 40 weight percent at a total coating weight of 1.25 weight percent, which coatings are not in close proximity in the triboelectric series, U.S. Pat. Nos. 4,935,326 and 4,937,166, the disclosures of which are totally incorporated herein by reference. With the aforementioned carriers, in some embodiments from about 0.1 to about 0.5 weight percent of the charge enhancing additive can be selected. Accordingly, for example, small amounts of charge enhancing additives can be selected for developers with carrier particles containing a double polymeric coating thereover.

The following Examples are being provided. Parts and percentages are by weight unless otherwise indicated.

COMPARATIVE EXAMPLE I

A toner without any charge control additive, or charge enhancing additive was prepared by melt mixing in the extrusion device Haake Rheomix TYPE 557–1302 obtained from Polylab System, 60 grams of a polyester resin that was comprised of 80 parts by weight of 4,4'-hydroxy ethoxy bisphenol A terephthalate and 20 parts by weight of 1,4-cyclohexane dimethanol terephthalate. The product was heated at 120° C. for 20 minutes in the above mixer with the rpm speed at 100. Subsequently, the resulting polyester extruded resin was subjected to grinding in a micronizer, Sturtevant Mill Company, Boston, Mass. enabling polyester particles with a volume median diameter of 5.9 microns as measured by a Coulter Counter.

The charging performance of the above was evaluated by weighing a developer in a glass bottle which developer was comprised of 1.5 grams of a toner comprised of 100 percent of the above polyester resin and 30 grams of carrier comprised of a 35 micron diameter Mn—Mg—Sr-Ferrite core coated with 2.3 percent by weight of perfluoro-octyl-ethyl-methacrylate/methyl methacrylate copolymer containing 0.26 percent by weight of a Vulcan conductive carbon black obtained from Cabot Corporation, and 0.3 percent by weight of Epostar-S from Nippon Shukobai. Two samples, about 10 grams each, of prepared developer were conditioned overnight, about 18 to 24 hours, in environmental chambers referred to as A-zone and C-zone, where A-zone was operating at 15° C. and 10 percent relative humidity, and C-zone was operating at 28° C. with 85 percent relative humidity. After conditioning, samples were charged for 2 minutes on a Turbula mixer with an rpm of 100, available from Willy A. Bachofen AG Maschinenfabrik, Basel, Switzerland. Toner charge-to-diameter ratios, q/d, were measured on a known standard charge spectrograph. The measured q/d was −0.28 femtocoulombs/micron in C-zone and −0.07 femtocoulombs/micron in A-zone, and the ratio of C-zone q/d to A-zone q/d, known as toner sensitivity to relative humidity or RH sensitivity, was 4.1.

EXAMPLE II

A toner was prepared as in Comparative Example I except a charge additive was selected. More specifically, the resin of Comparative Example I contained in the Haake mixer was mixed with 1.2 grams of the complex charge additive aluminum sulfate (Aldrich Chemical Company), corresponding to 2 percent by weight of aluminum sulfate in the toner. The resulting toner particles comprised of 2 weight percent of the above CCA (charge additive) and 98 weight percent of resin had a volume median diameter of 4.2 microns. Toner charge was measured as in Comparative Example I, providing a measured q/d of −0.66 femtocoulombs/micron in C-zone and −0.25 femtocoulombs/micron in A-zone. Compared to Comparative Example 1, q/ds in A-zone and C-zone of the toner of Example II were substantially improved by 134 percent and 260 percent, respectively. Addition of the 2 percent aluminum sulfate also resulted in about 35 percent improvement in toner sensitivity to relative humidity of from 4.1 to 2.7; the lower the RH ratio the less sensitive the toner charge is to relative humidity.

EXAMPLE III

A toner was prepared as in Comparative Example I, but with a charge control agent, and more specifically, by mixing with the resin in the Haake mixer 1.8 grams of aluminum sulfate (Aldrich Chemical Company) charge additive, corresponding to 3 percent by weight of aluminum sulfate in the toner. The resulting toner particles comprised of 3 weight percent of the above CCA and 97 weight percent of the resin had a volume median diameter of 6.1 microns. Toner charge was measured as in Comparative Example I, providing a measured q/d of −0.40 femtocoulombs/micron in C-zone and −0.15 femtocoulombs/micron in A-zone. Compared to Comparative Example 1, q/ds in A-zone and C-zone are substantially improved by 42 percent and 116 percent, respectively. The addition of 3 percent aluminum sulfate also resulted in significant improvement in toner sensitivity to relative humidity from 4.1 to 2.7.

COMPARATIVE EXAMPLE IV

The toner of Comparative Example I was further evaluated by weighing a developer in a glass bottle, which developer was comprised of 1 gram of toner and 24 grams of carrier comprised of 65 microns carbon-steel core coated with 1 percent by carrier weight polymethylmethacrylate containing 18 percent by weight of carbon black. Samples, about 10 grams, were conditioned overnight, 18 hours, at 20 percent and at 80 percent relative humidity at room temperature, about 25° C. before charging for 30 minutes on a roll mill (Norton CV75190, Akron, Ohio). Toner charge-to-diameter ratios, q/ds, were measured on the standard known charge spectrograph. The measured q/d was −0.40 femtocoulombs/micron at 20 percent RH and −0.21 femtocoulombs/micron at 80 percent RH. The q/ms (charge-to-mass ratios) of the toner was measured by the known standard blow-off Faraday Cage method. The measured q/m was −17.7 microcoulombs/gram at 20 percent RH and −10.3 microcoulombs/gram at 80 percent RH.

TONER EXAMPLE V

A toner was prepared as in Comparative Example IV, but with the addition to the resin in the Haake mixer of 0.6 gram of zinc acetate dihydrate (Aldrich Chemical Company), corresponding to 1 percent by weight of zinc acetate dihydrate (CCA) in toner. The resulting toner particles comprised of 1 weight percent of the above CCA and 99 weight percent of the resin had a volume median diameter of 5.6 microns. Toner charge was measured according to Comparative Example IV providing a measured q/d of −0.58 and −0.38 femtocoulombs/micron at 20 percent and 80 percent RH, respectively, and q/m of −23.0 and −18.4 femtocoulombs/gram at 20 and 80 percent RH, respectively. Compared to Example IV, the addition of 1 percent of the above CCA improved q/d by 45 to 80 percent and desirably decreased the RH ratio from 1.9 to 1.5. Furthermore, compared to the toner of Comparative Example IV, charge-to-mass ratio of the above prepared toner of Example V was enhanced by 35 to 80 percent resulting in considerable decrease in RH sensitivity from 1.7 to 1.25.

TONER EXAMPLE VI

A toner was prepared as in Comparative Example IV, but with the addition to the resin in the Haake mixer of 1.2 grams of zinc acetate dihydrate (Aldrich Chemical Company) corresponding to 2 percent by weight of zinc acetate dihydrate charge additive (CCA) in the toner. The resulting toner particles comprised of 2 weight percent of the above CCA and 98 weight percent of the resin had a volume median diameter of 6 microns. Toner charge was measured according to Comparative Example IV providing a measured q/d of −0.70 and 0.38 femtocoulombs/micron at 20 percent and 80 percent RH, respectively, and q/m of −30.3 and −19.2 femtocoulombs/gram at 20 and 80 percent RH, respectively. Compared to Example IV, the addition of 2 percent of the above CCA significantly improved q/d by about 75 to 80 percent and q/m by about 70 to 100 percent.

TONER EXAMPLE VII

A toner was prepared as in Comparative Example IV, but with the addition to the resin in the Haake mixer of 1.8 grams of zinc acetate dihydrate (Aldrich Chemical Company) corresponding to 3 percent by weight of zinc acetate dihydrate CCA in the toner. The resulting toner particles comprised of 3 weight percent of the above CCA and 97 weight percent of the above resin had a volume median diameter of 6.8 microns. Toner charge was measured according to Comparative Example IV, providing a measured q/d of −0.54 and −0.29 femtocoulombs/micron at 20 percent and 80 percent RH, respectively, and q/m of −36.0 and −17.4 femtocoulombs/gram at 20 and 80 percent RH, respectively. Compared to Example IV, the addition of 3 percent of the above CCA resulted in a considerable increase in q/d (from 35 percent at 20 percent RH to 38 percent at 80 percent RH) and in q/m (from 70 percent at 80 percent RH to 100 percent at 20 percent RH).

TONER COMPARATIVE EXAMPLE VIII

The toner of Comparative Example I was evaluated by weighing a developer in a glass bottle which developer was comprised of 1 gram of toner and 24 grams of carrier comprised of 65 microns carbon-steel core coated with 1 percent by carrier weight of a polymethylmethacrylate containing 18 percent by coating weight of VULCAN conductive carbon black obtained from Cabot Corporation. Samples of the developer comprised of 24 grams of carrier and 1 gram toner were tested after being conditioned overnight, 18 hours, at 50 percent relative humidity and at room temperature, before charging for 1, 15 and 90 minutes on a paint shaker (5400 Paint Mixer, Red Devil). Toner charge-to-diameter ratios, q/ds, were measured on the standard charge spectrograph. The measured q/ds after 1, 15 and 90 minutes charging were −0.31, −0.39 and −0.46 femtocoulombs/micron respectively. The q/ms (charge-to-mass ratios) of the toner were measured by the standard known blow-off method. The measured q/ms, corresponding to the mentioned above time intervals, were respectively −22.0, −23.0 and −23.0 microcoulombs/gram.

TONER EXAMPLE IX

Three toners were prepared with a charge control agent as in Comparative Example I but with the addition to the resin in the Haake mixer of 0.6, 1.2 or 1.8 grams of zinc acetate dihydrate (Aldrich Chemical Company) charge control agent (CCA) corresponding to 1, 2 or 3 percent by weight of zinc acetate dihydrate in toner. The resulting toner particles comprised of 1, 2 or 3 weight percent of the above CCA and, respectively, 99, 98 or 97 weight percent of the resin had volume median diameters of 5.6, 6 and 6.8 microns for toners containing 1, 2 and 3 percent zinc acetate, respectively. Developers were prepared using the carrier of Comparative Example VIII and toner charge was measured according to the method in Comparative Example VIII providing measured q/ds and q/ms as tabulated in the following table.

| | | Paint shake aging q/m (fC/g) | | | Paint shake aging q/d (fC/um) | | |
|---|---|---|---|---|---|---|---|
| | | 1' | 15' | 90' | 1' | 15' | 90' |
| Comparative Example VIII | Resin only | −22.0 | −23.0 | −23.0 | −0.31 | −0.39 | −0.46 |

-continued

| | | Paint shake aging q/m (fC/g) | | | Paint shake aging q/d (fC/um) | | |
|---|---|---|---|---|---|---|---|
| | | 1' | 15' | 90' | 1' | 15' | 90' |
| Example IX | 1% Zn Acetate | −23.3 | −32.0 | −32.1 | −0.34 | −0.37 | −0.56 |
| | 2% Zn Acetate | −26.5 | −32.0 | −32.6 | −0.52 | −0.59 | −0.62 |
| | 3% Zn Acetate | −30.1 | −34.0 | −30.6 | −0.46 | −0.59 | −0.57 |

Compared to the toner without added charge control agent, it is apparent that in general the addition of zinc acetate hydrate resulted in higher charge over the 90 minutes of developer aging. Further, the higher charge is very stable and shows no decrease with time, and some charge increase.

COMPARATIVE EXAMPLE X

Toners Containing Prior Art CCAs

A toner was prepared as in Comparative Example I but with the addition to 49.5 grams of resin in the Haake mixer of 0.5 gram of BONTRON E-88®, aluminum alkyl salicylate, reference U.S. Pat. No. 4,845,003, the disclosure of which is totally incorporated herein by reference, and which BONTRON E-88® was obtained from Orient Chemicals, as charge control agent, corresponding to 1 percent by weight of BONTRON E-88® in toner. The resulting toner particles comprised of 1 weight percent of the above CCA and 99 weight percent of the resin had volume median diameters of 6.3 microns for toner containing 1 percent BONTRON E-88®. Developers were prepared using the carrier of Example V and toner charge was measured according to the method in Example V providing measured q/ds and q/ms as tabulated in the following table. The toner containing 1 percent Zn-Acetate has a much lower sensitivity to relative humidity and had better performance compared with the toner containing the prior art CCA, BONTRON E-88®.

| | | q/m (fC/g) | | | q/d (fC/um) | | |
|---|---|---|---|---|---|---|---|
| | | 20% | 80% | RH Ratio | 20% | 80% | RH Ratio |
| Comparative Example X | 1% E88 | −54.9 | −22.9 | 2.4 | −1.1 | −0.27 | 4.0 |
| Example V | 1% Zn Acetate 3% Zn Acetate | −23.0 | −18.4 | 1.3 | −0.58 | −0.38 | 1.5 |

COMPARATIVE EXAMPLE XI

Toners Containing Prior Art CCAs

A toner was prepared as in Comparative Example I but with the addition to 48.5 grams resin in the Haake mixer of 1.5 grams of BONTRON E-88® from Orient Chemicals as charge control agent, corresponding to 3 percent by weight of BONTRON E-88® in toner. The resulting toner particles comprised of 3 weight percent of the above CCA and 97 weight percent of the resin had volume median diameters of 5.7 microns for toner containing 3 percent BONTRON E88®. Developers were prepared using the carrier of Example VII and toner charge was measured according to the method in Example VII, providing measured q/ds and q/ms as tabulated in the following table. The toner containing 3 percent Zn-Acetate had a lower sensitivity to relative humidity and had better performance characteristics as compared to the toner containing the prior art CCA, E-88®. Furthermore, the addition of 3 percent E-88® resulted in an unacceptably high charge of −76.6 femtocoulombs/gram, which is outside of a desired range for the toner charge at 20 percent relative humidity.

| | | q/m (fC/g) | | | q/d (fC/um) | | |
|---|---|---|---|---|---|---|---|
| | | 20% | 80% | RH Ratio | 20% | 80% | RH Ratio |
| Comparative Example X | 3% E88 | −76.6 | −32.2 | 2.4 | −1.10 | −0.29 | 3.8 |
| Example VII | 3% Zn Acetate 3% Zn Acetate | −36.0 | −17.4 | 2.1 | −0.54 | −0.29 | 1.9 |

Similar toners can be prepared as illustrated above, and with the addition of a colorant, such as carbon black, REGAL 330®, about 10 weight percent.

Other modifications of the present invention may occur to those skilled in the art subsequent to a review of the present application, and these modifications, including equivalents thereof, are intended to be included within the scope of the present invention.

What is claimed is:

1. A toner comprised of colorant resin and a charge additive comprised of a complex of a hard acid and a hard base and wherein said charge additive is selected from the group consisting of zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III) carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, and ammonium sulfate.

2. A toner in accordance with claim 1 wherein said charge additive is present as an internal toner component.

3. A toner in accordance with claim 1 wherein the charge additive is $Zn(CH_3CO_2)_2$, $Al(CH_3CO_2)_3$, $Al_2(CO_3)_3$, $AlPO_4$, $ZnSO_4$, $ZnCO_3$, $Zn(NO_3)_2$, $Ti(SO_4)_2$ $Ti(CH_3CO_2)_4$, $Cr(CH_3CO_2)_3$, $Cr_2(SO_4)_3$, or $Cr(CH_3CO_2)_3$.

4. A toner in accordance with claim 1 wherein said charge additive is zinc acetate dihydrate.

5. A toner in accordance with claim 1 wherein said charge additive is chromium acetate.

6. A toner in accordance with claim 1 further containing a second charge enhancing additive selected from the group consisting of distearyl methyl hydrogen ammonium bisulfate, didodecyl methyl ammonium hydrogen bisulfate, dihexadecyl methyl ammonium hydrogen bisulfate, distearyl ethyl ammonium hydrogen bisulfate, and bis-(distearyl methyl hydrogen ammonium) sulfate, wherein the first charge additive is optionally present in an amount of from about 0.05 to about 5 weight percent of said toner components and the second charge additive is optionally present in an amount of from about 0.05 to about 5 weight percent of said toner components.

7. A toner in accordance with claim 1 wherein the charge additive is present in an amount of from about 0.05 to about 5 weight percent of said toner components, and wherein the total of said toner components, including the charge additive, are present in an amount of about 100 percent.

8. A toner in accordance with claim 1 wherein the resin is comprised of styrene polymers, polyesters, or mixtures thereof.

9. A toner in accordance with claim 1 wherein the resin is comprised of styrene acrylates, styrene methacrylates, or styrene butadienes.

10. A toner in accordance with claim 1 containing a wax component with an optional weight average molecular weight of from about 1,000 to about 10,000.

11. A toner in accordance with claim 1 containing as external surface additives metal salts of a fatty acid, colloidal silicas, metal oxides, or mixtures thereof.

12. A developer comprised of the toner composition of claim 1 and carrier.

13. A method of imaging which comprises formulating an electrostatic latent image on an imaging member, affecting development thereof with the toner of claim 1, and optionally thereafter transferring the developed image to a suitable substrate.

14. A toner composition comprised of resin, colorant, a charge enhancing additive selected from the group consisting of zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III) carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, and ammonium sulfate; a wax selected from the group consisting of polypropylene, polyethylene, and mixtures thereof; and present on the toner surface thereof external flow aid additives.

15. A toner composition in accordance with claim 14 wherein said colorant is carbon black, magnetite, or mixtures thereof; cyan, magenta, yellow, red, blue, green, brown, or mixtures thereof.

16. A toner composition in accordance with claim 14 wherein the colorant is carbon black.

17. A developer composition comprised of the toner composition of claim 2 and carrier particles.

18. A developer composition in accordance with claim 17 wherein the carrier core particles are comprised of ferrites, steel, or an iron powder.

19. A developer composition in accordance with claim 17 wherein the carrier particles are comprised of a core with a polymer coating thereover.

20. A developer composition in accordance with claim 19 wherein the coating is comprised of a methyl terpolymer, a polyvinylidine fluoride, a polymethyl methacrylate, or a mixture of polymers not in close proximity in the triboelectric series.

21. A single component toner composition comprised of resin, magnetite, and a charge enhancing additive comprised of a complex of a hard acid and a hard base wherein said charge enhancing additive is present as an internal component, and wherein said charge additive is selected from the group consisting of zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III) carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, and ammonium sulfate.

22. A toner composition comprised of resin, colorant, and a charge enhancing additive that primarily functions to assist in increasing the charge on said toner, and wherein said charge enhancing additive is a zinc acetate dihydrate, and which toner optionally further includes a wax, a second charging enhancing additive and as a surface additive a silica, a metal salt of a fatty acid or a metal salt.

* * * * *